US005812032A

United States Patent [19]

Stitzer

[11] Patent Number: 5,812,032

[45] Date of Patent: Sep. 22, 1998

[54] STRIPLINE TRANSITION FOR TWIN TOROID PHASE SHIFTER

[75] Inventor: Steven N. Stitzer, Ellicott City, Md.

[73] Assignee: Northrop Grumman Corporation, Los Angeles, Calif.

[21] Appl. No.: 811,792

[22] Filed: Mar. 6, 1997

[51] Int. Cl.[6] ..... H01P 1/32

[52] U.S. Cl. ..... 333/24.1; 333/26; 333/34; 333/158

[58] Field of Search ..... 333/24.1, 26, 33–35, 333/156, 158; 343/767

[56] References Cited

U.S. PATENT DOCUMENTS

| | | | |
|---|---|---|---|
| 2,761,845 | 9/1956 | Ajoika et al. | 333/24.1 |
| 3,732,508 | 5/1973 | Ito et al. | 333/26 X |
| 3,845,490 | 10/1974 | Manwarren et al. | 333/26 X |
| 4,636,757 | 1/1987 | Harrison et al. | 333/26 X |
| 5,075,648 | 12/1991 | Roberts et al. | 333/26 X |
| 5,093,639 | 3/1992 | Franchi et al. | 333/35 X |

FOREIGN PATENT DOCUMENTS

| | | | |
|---|---|---|---|
| 56-125101 | 10/1981 | Japan | 333/26 |

OTHER PUBLICATIONS

El–Sharawy, "Dual–Ferrite Slot Line . . . Phase Shifters", IEEE Trans. on Microwave theory & Tech., vol. 39, No. 12, pp. 2204–2210, Dec. 1991.

*Primary Examiner*—Seungsook Ham
*Attorney, Agent, or Firm*—Walter Sutcliff

[57] ABSTRACT

A microwave transition consisting of a stripline member coupled to a pair of slot lines deposited on the outer surfaces of a pair of contiguous dielectric rib members. The stripline and one slot line on one of the rib members cross each other at right angles on parallel planes forming an energy coupling junction. One end of both slot lines comprise slot line regions which are either smooth tapered or stepped out to the full width of the dielectric ribs so as to couple RF energy to the normal fields in a twin toroid phase shifter which in one embodiment the toroids extend past the cross-over junction while in the second embodiment two additional dielectric layers are contiguously applied to the outside surfaces of the dielectric rib members containing the slot lines for matching the electric fields in the slots to the toroids. The outer surfaces of the transition including the twin toroids are metallized and fitted into a metal sleeve which provides support for the composite structure.

14 Claims, 4 Drawing Sheets

FIG. 7
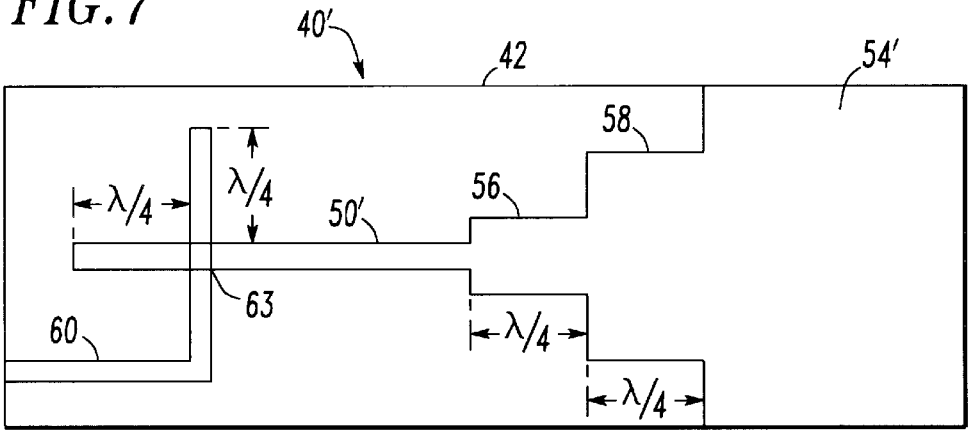
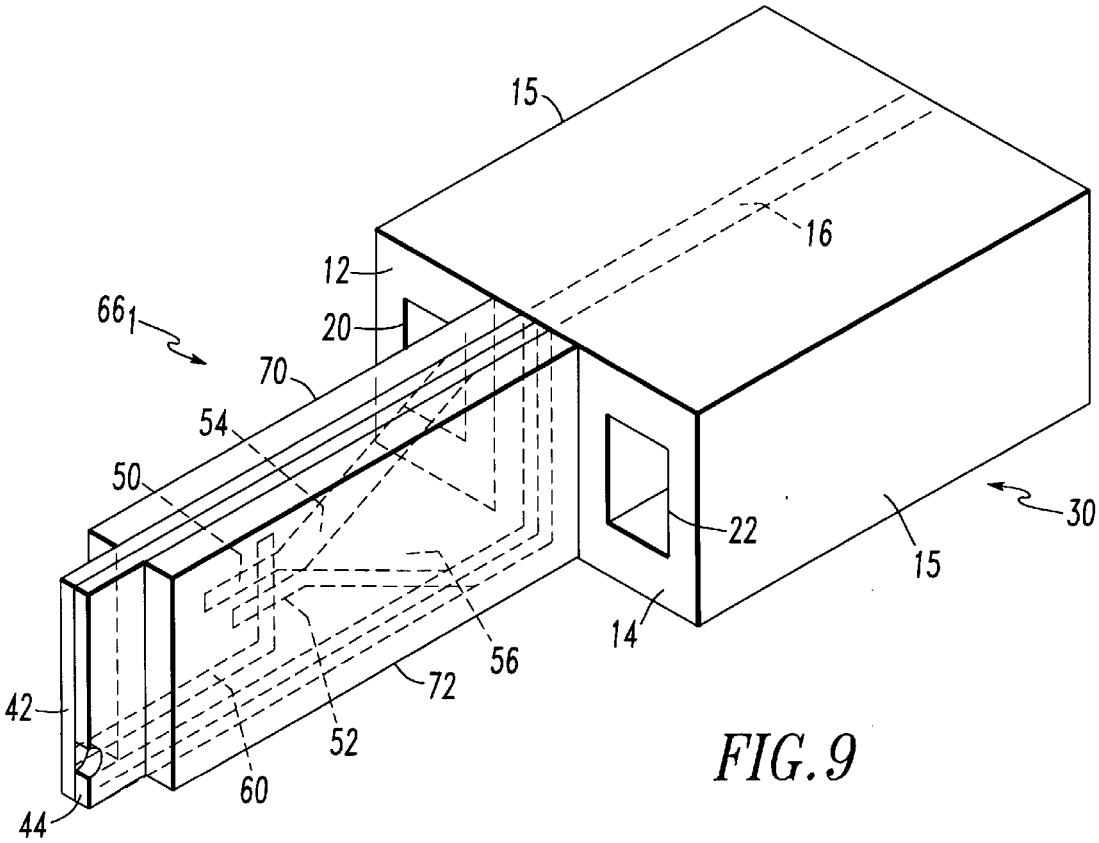
FIG. 9

STRIPLINE TRANSITION FOR TWIN TOROID PHASE SHIFTER

BACKGROUND OF THE INVENTION

1. Field of the Invention

This invention relates generally to transitions from one type of microwave transmission line to another and more particularly to a stripline transition to a twin toroid phase shifter.

2. Description of the Prior Art

Toroid phase shifters are well-known devices in the field of microwave technology for shifting the phase of a microwave signal propagating along a microwave transmission line. Ferrite toroid phase shifters are also well-known devices and have been extensively used in phased array antennas because their insertion loss is low, RF power handling is high, and drive power is low compared to solid state devices.

The toroid phase shifter is essentially a rectangular waveguide such as shown in FIG. 1 loaded at its center with a high $\epsilon_r$ dielectric and ferrite. The phase shifter configuration shown in FIG. 1 includes a metal housing or waveguide 10 enclosing two elongated ferrite toroids 12 and 14 of rectangular cross-section which are separated by a dielectric rib member 16 having a relatively high dielectric constant $\epsilon_r$. Such a structure is known in the art as a twin toroid phase shifter. The phase shift of a microwave signal propagating through the phase shifter undergoes a predetermined phase shift per unit length which is varied by setting the level of DC magnetization in the ferrite by passing a control current through a wire 18 which threads through air-filled central rectangular bores 20 and 22 in the toroid members 12 and 14.

A twin toroid phase shifter such is shown in FIG. 1 can be matched to rectangular waveguide 24, such as shown in FIG. 2, by means of a transition section 26 of waveguide which is center loaded with a dielectric member 28 aligned with the dielectric rib 16 between the twin toroids 12 and 14. The transition section 26 acts as an impedance matching section and also pulls the sin (x)-shaped RF fields in the rectangular waveguide into the highly peaked fields at the center.

Previous transitions to stripline or microstrip components have been relatively difficult to design, fabricate and adjust because the respective field shapes are completely different. One such transition is shown in FIG. 3 where a ribbon band to microstrip transition is shown consisting of a twin toroid phase shifter 30 including ferrite toroids 12 and 14 and an intermediate dielectric rib 16 which have a layer of metallization surrounding the elements. A capacitor 31 is placed on top of the rib 16 to which is attached a ribbon type conductor 32 which in turn couples to a microstrip conductor 34 on a substrate 36 by means of a second capacitor 38. Such an arrangement requires critical parts placement and there is always a problem of possible radiation from the ribbon conductor 32.

SUMMARY OF THE INVENTION

Accordingly, it is an object of the present invention to provide an improvement in microwave circuitry.

It is another object of the invention to provide an improvement in such apparatus for effecting a transition from one type of microwave structure to another.

It is a further object of the invention to provide a transition from stripline to a ferrite phase shifter.

It is still another object of the invention to provide a stripline transition to a twin toroid microwave ferrite phase shifter.

The foregoing and other objects are achieved by a microwave transition comprised of a stripline member coupled to a pair of slot lines formed on the outer metallized surfaces of a pair of contiguous dielectric rib members. The stripline and slot line form a junction by crossing each other at right angles on parallel planes. The slots widen out forward of the junction to the full width of the dielectric rib members so as to couple RF energy to and from the two ferrite toroids which in one embodiment extend past the junction while in a second embodiment two additional dielectric layers are contiguously applied to the outside surfaces of the dielectric rib members containing the slot lines. The outer surfaces of the transition including the twin toroids are further metallized and fitted partially, at least, into a metal sleeve.

Further scope of applicability of the present invention will become apparent from the detailed description thereof which will be provided hereinafter. It should be understood, however, that the detailed description while indicating preferred embodiments of the invention are provided by way of illustration only and thus are not meant to be limitative, since various changes and modifications within the scope of the invention will readily become apparent to those skilled in the art.

BRIEF DESCRIPTION OF THE DRAWINGS

The present invention will become more fully understood from the detailed description when taken together with accompanying drawings wherein:

FIG. 7 is a flat planer view further illustrative of the stepped slot transition shown in FIG. 6;

FIG. 9 is a partial perspective view of the embodiment shown FIG. 8;

DETAILED DESCRIPTION OF THE PREFERRED EMBODIMENTS

Figure 1:
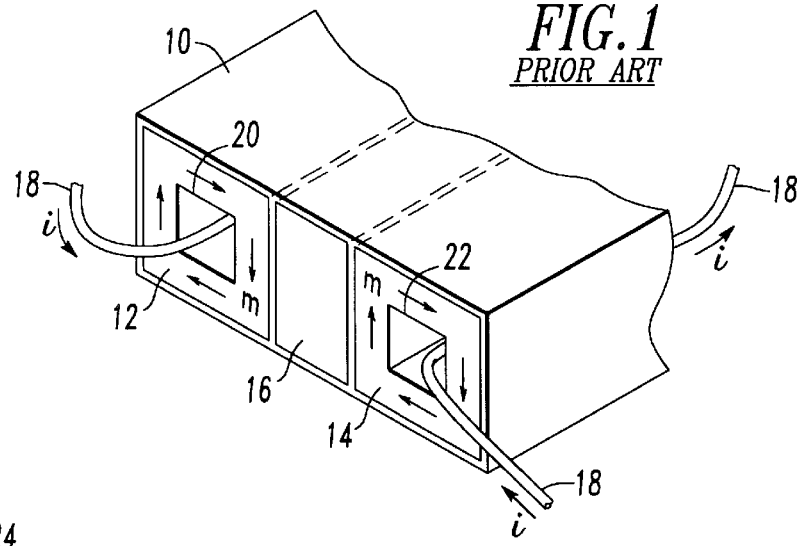
FIG. 1 PRIOR ART
FIG. 1 is a partial perspective view of a twin toroid microwave phase shifter.
Figure 4:
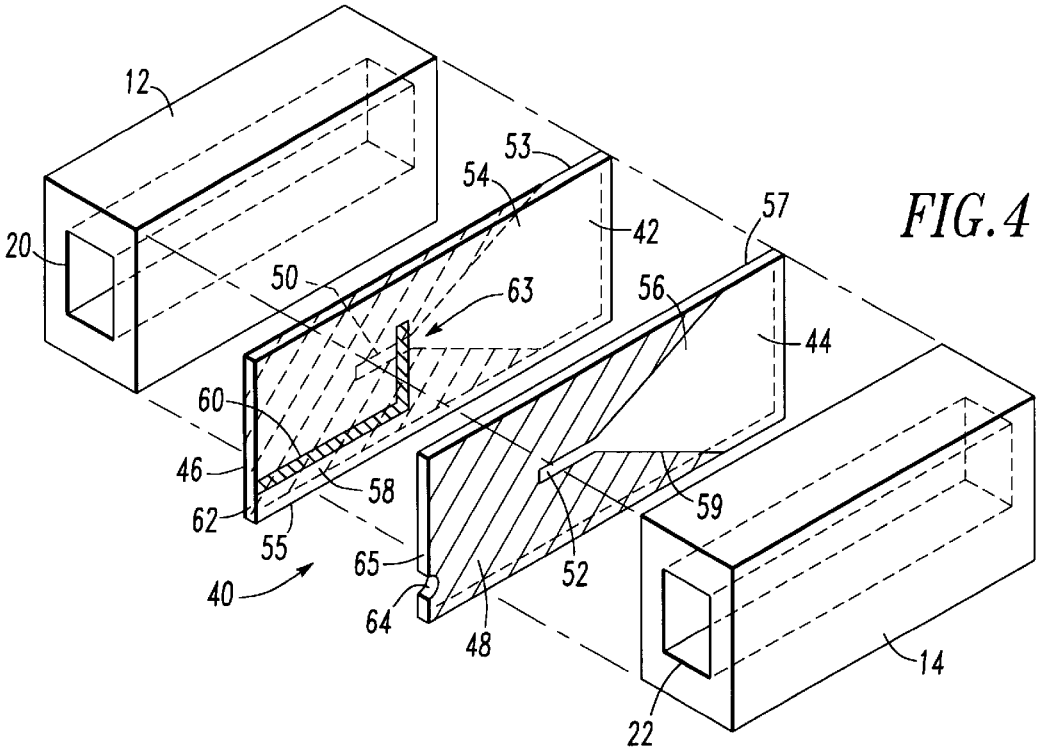
FIG. 4 is a exploded perspective view of a first embodiment the invention.

The present invention is based upon the fact that the electric field in a twin toroid phase shifter as shown in FIG. 1 is confined substantially parallel to the center rib member 16. If conducting fins are formed on the vertical outside walls of the rib 16 and grounded to the top and the bottom walls of a waveguide, the E-fields tend to be concentrated in the region between edges of the fins but still with the same general shape. If the edges of the fins are brought closer together, they form a slot line which can then be coupled to a strip transmission line by crossing the slot with a strip at right angles but on mutually different planes. FIG. 4 shows such a structure.

Referring now to FIG. 4, one preferred embodiment of the invention comprises a stripline 40 to a twin toroid phase shifter 30 which now includes an intermediate stripline to slot line transmission structure comprised of two flat relatively thin dielectric members 42 and 44 having outer surfaces 46 and 48 of metallization and containing respective relatively narrow slot regions 50 and 52 of constant width which then widens out into a smooth tapered slot region 54 and 56, respectively to the side edges 53, 55 and 57, 59. Such a metallization pattern can be formed photolithographically in a well-known manner on the metallized surfaces 46 and 48. One of the inside surfaces, for example, the inside surface 58 of the dielectric member 42 includes a length of stripline 60 which extends line from the outer edge 62 to a point substantially one-quarter wavelength from the terminal end slot 50 where it makes a right angled turn and then extends upward and crosses the slot 50, forming an energy coupling junction 63. The stripline 60 then extends beyond the slot 50 for another one-quarter wavelength. The stripline 60 and the slot 50, moreover, are located on mutually parallel planes formed by the outer and inner surfaces 46 and 58 of the dielectric member 42.

Figure 5:
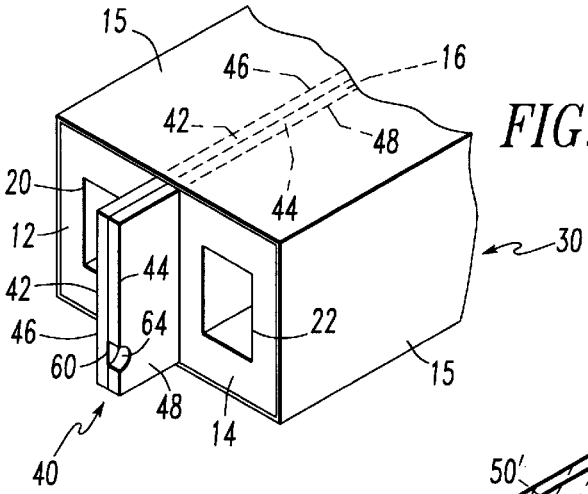
FIG. 5 is a partial perspective view further illustrative of embodiment shown in FIG. 4.

The opposing dielectric member 44 includes a semicircular or similar-shaped notch 64 along the outer edge 65 so that an external connection can be made to the stripline member 60 when the two dielectric members 42 and 44 are contiguously brought together between a twin toroid phase shifter 30 including ferrite toroids 12 and 14 and its dielectric rib 16 as shown in FIG. 5. Thus the stripline 60 extends approximately one-quarter wavelength past the junction 63 and ends in an open circuit. Each slot 50 moreover extends approximately one-quarter wavelength past the junction 63 toward the feed end and ends in a short circuit. The lengths and impedances of the stripline 60 and slot line 50 can be adjusted to optimize return loss over a prescribed bandwidth.

Figure 6:
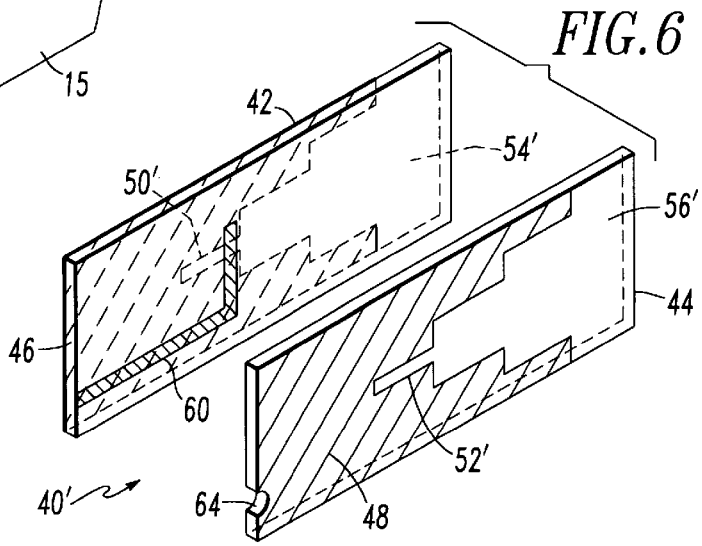
FIG. 6 is a perspective view illustrative of a stepped slot transition in accordance with the subject invention.

The stripline 60 is designed as a conventional strip between two ground planes formed by the slot line middle planes consisting of the layers of metallization 46 and 48 and have a dielectric constant of the dielectric members 42 and 44 and defined as $\epsilon_{rib}$. The slot lines are comprised of first and second slot line sections 50, 54 and 52, 56 have a dielectric constant $\epsilon_{rib}$ on one side and $\epsilon_{ferrite}$ on the other side. The second slot line sections 54 and 56 are tapered as shown in FIG. 4 or stepped in an outward direction to the full height of the toroids as shown in FIGS. 6 and 7 where two one-quarter wavelength steps are shown for the slot line connection 54' and 56'. In either the tapered or stepped configuration, the goal is a gradual transition of the slot line fields into the toroid field shape which as noted above resides primarily in the dielectric rib 16 of the twin toroid phase shifter as shown, for example, in FIG. 5.

The transition 40 is fabricated, for example, by: forming the strip and slot-to-fin metallization patterns 46 and 48 photolithographically on the outer surfaces of the two layers of dielectric 42 an 44 which form the center rib section; fabricating two ferrite toroids 12 and 14 by conventional means; applying adhesive between the dielectric rib layers 42 and 44 and the toroids 12 and 14 and assembling the parts; and metallizing the outside of the assembly with metallization 15. The assembled unit is then installed and a wire bond or similar attachment is made to the stripline 60 extending out to the notch 64.

Figure 8:
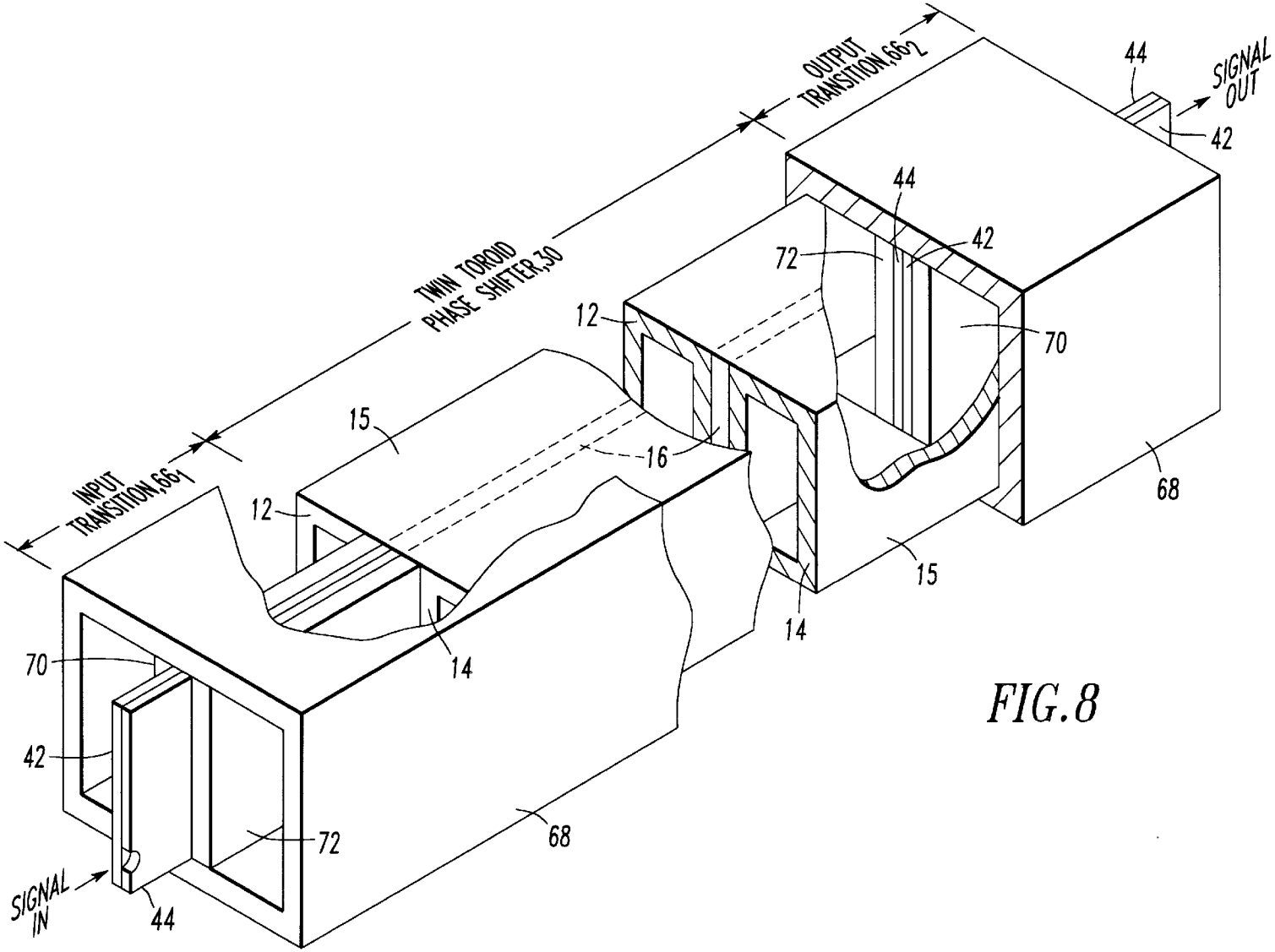
FIG. 8 is a cutaway perspective view illustrative of a second embodiment of the invention.

FIGS. 8 and 9 are intended to illustrate not only a pair of transitions on each end of a twin toroid phase shifter but also a second embodiment 66 of the transition 40. FIG. 8, for example, discloses an input transition $\mathbf{66}_1$, and output transition $\mathbf{66}_2$ of identical construction located on either end of a twin toroid phase shifter 30 and which are enclosed in a metal housing 68. It should be noted that a pair of transitions identified by reference numerals 40 and 40' as shown in FIGS. 4 and 6 may be substituted for the transitions $\mathbf{66}_1$, and $\mathbf{66}_2$ when desirable.

The details of the transitions $\mathbf{66}_1$, and $\mathbf{66}_2$ are shown in FIG. 9. There an input transition $\mathbf{66}_1$, is shown including a second pair of flat dielectric members 70 and 72 respectively affixed to the dielectric rib members 42 and 44 adjacent the slot line sections 50 and 52 of the transition including the stripline to slot line junction 63. The inner extremities of the dielectric members 70 and 72 are coextensive with the inner extremities of the dielectric rib members 42 and 44 and terminate at the near end of the dielectric rib member 16 of the twin toroid phase shifter as before.

The outside of the rib members 42 and 44 are metallized so as to confine the fields within the dielectric layers 70 and 72. Fields are confined within the two additional dielectric members 70 and 72 by the metal housing 68. It should be noted that the center rib assembly of the transition 66 or 40 including the dielectric members 40 and 42 as well as the additional dielectric members 70 and 72 can be fabricated either by gluing together conventional ceramics or it may be implemented with low temperature co-fired ceramics (LTCC). The latter would eliminate any air gap between two adjoining members of the rib assembly. It should also be noted that a transition in accordance with this invention can be made as a separate assembly which can be attached to the end of a conventional toroid and a unitary metal housing 68 or a pair of metal housing sections containing the transitions may be employed as required.

Figure 2:
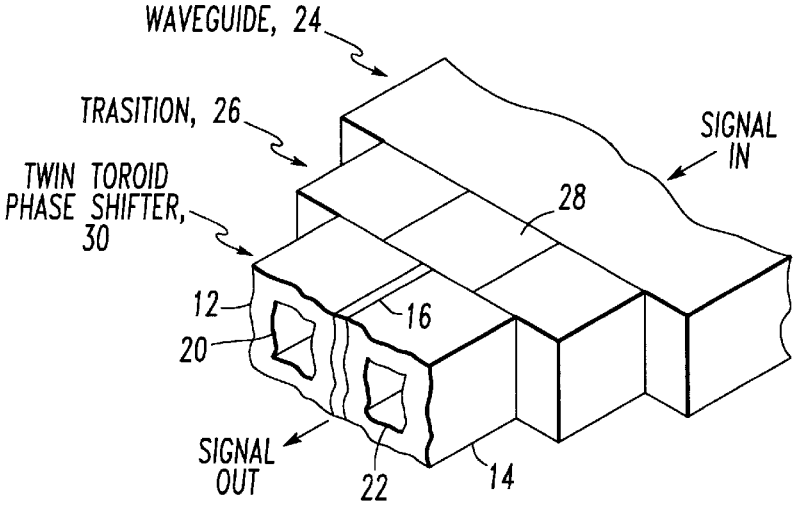
FIG. 2 PRIOR ART
FIG. 2 is a partial perspective view illustrative of a transition between a microwave waveguide and a twin toroid phase shifter in accordance with the known prior art.
Figure 3:
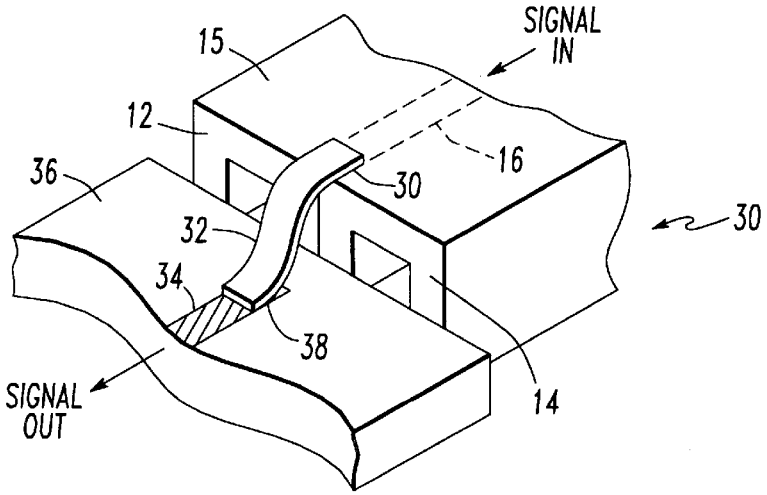
FIG. 3 PRIOR ART
FIG. 3 is a partial perspective view generally illustrative of a known transition from a stripline to a twin toroid Phase shifter.

The embodiments of the present invention provides several advantages over the known prior art. For example, the stripline connection allows a ferrite phase shifter to be used with stripline or microstrip feeds. A stripline-to-microstrip or other TEM-like transmission line transition can be incorporated into a section of substrate extending past the end of the toroids 12 and 14. No tuning is needed since photolithographically formed conductors are highly reproducible. Additionally, the length of the toroids 12 and 14 is not critical. Only the section of toroid extending past the open ends 54 and 56 of the slot line contributes to the phase shift. Moreover, virtually no RF travels past the short at the other ends 50 and 52 of slot. This eliminates the expensive toroid machining step of grinding to length as required heretofore. Furthermore, in the embodiment of FIG. 5 the ends of the toroids can be left open or they can be metallized. It is of no significance since no RF flows through the ends of the toroids 12 and 14. This means that the whole assembly can be metallized after assembly without concern for flash over of metal on the ends of the toroids 12 and 14. Even some metal inside the ends of the toroids 12 and 14 will have no effect. Finally, the magnetizing wire(s) 18 (FIG. 1) have an unobstructed entry into the toroids 12 and 14 as compared to the case of toroids inside a waveguide housing 26 such as shown in FIG. 2.

Having thus shown and described what is at present considered to be the preferred embodiments of the invention, it should be noted that the same has been made by way of illustration and not limitation. Accordingly, all modifications, alterations and changes coming within the spirit and scope of the invention as set forth in the appended claims are meant to be included.

What is claimed is:

1. A microwave phase shifter including a transition for coupling microwave energy from one type of microwave transmission line to another, comprising:

a pair of contiguous elongated dielectric members each having mutually opposing inner and outer surfaces, said dielectric members having a respective pattern of metallization formed on the outer surfaces thereof, each said pattern of metallization comprising a slotline including a first slot region of relatively narrow width directed toward one end of said pair of dielectric members and a second slot region adjoining said first slot region which widens outwardly toward the other end of said pair of dielectric members;

a length of conductive stripline formed on the inner surface of one of said pair of dielectric members and extending from said one end of said dielectric member inwardly to said first slot region and crossing over said first slot region at a right angle at a predetermined distance from the end thereof so as to form a microwave energy coupling junction with said first slot region;

a twin ferrite toroid phase shifter including two ferrite toroids separated along their lengths by a rib of dielectric material, one end of said rib of dielectric material being aligned with and butted against said other ends of said pair of dielectric members, and wherein said two toroids extend toward said one end of said dielectric members at least to said junction formed at the crossing of said length of stripline and said first slot region.

2. A microwave transition device according to claim 1 wherein said predetermined distance comprise about one-quarter wavelength of the microwave energy being coupled.

3. A microwave transition device according to claim 2 wherein said length of stripline also extends past said junction a distance of about one-quarter wavelength of the microwave energy being coupled.

4. A microwave transition device according to claim 1 wherein said second slot region widens out in a smooth taper or a stepped taper.

5. A transition device according to claim 1 wherein said second slot region widens out in a smooth taper to a pair of side edges of said pair of dielectric members.

6. A transition device according to claim 1 wherein said second slot region widens out in steps to a pair of side edges of said pair of dielectric members.

7. A transition device according to claim 6 wherein said steps have longitudinal lengths of about one-quarter wavelength of the microwave energy being coupled.

8. A transition device according to claim 1 wherein said two toroids extend past said junction.

9. A microwave phase shifter including a transition for coupling microwave energy from one type of microwave transmission line to another, comprising:

a pair of contiguous elongated dielectric members, each having mutually opposing inner and outer surfaces, said dielectric members having a respective pattern of metallization formed on the outer surfaces thereof, said pattern of metallization comprising a slotline including a first slot region of relatively narrow width directed toward one end of said pair of dielectric members and a second slot region adjoining said first slot region, which widens outwardly toward the other end of said pair of dielectric members;

a length of conductive stripline formed on the inner surface of one of said pair of dielectric members and extending from said one end of said dielectric member inwardly to said first slot region and crossing over said first flat region at a right angle at a predetermined distance from the end thereof so as to form a microwave energy coupling junction with said first slot region;

a twin ferrite toroid phase shifter including two ferrite toroids separated along their lengths by a rib of dielectric material, one end of said rib of dielectric material being aligned with and abutted against said other ends of said pair of dielectric members, and wherein said two toroids extend toward said one end of said pair of dielectric members adjacent an end portion of said second slot region and to said other ends of said pair of dielectric members, another pair of elongated dielectric members affixed to said outer surfaces of said pair of dielectric members for matching electric fields generated in the second slot region to the phase shifter and extending from one end of said two toroids at least to said junction formed at the crossing of said length of stripline and said first slot region.

10. A transition device according to claim 9 wherein said another pair of dielectric members extend past said junction.

11. A transition device according to claim 10 and additionally including a housing member for supporting at least said pairs of dielectric members.

12. A transition device according to claim 11 wherein said another pair of elongated dielectric members extend to an outer end of said housing.

13. A transition device according to claim 11 wherein said housing also supports a portion of said phase shifter.

14. A transition device according to claim 10 wherein said pairs of dielectric members comprise flat members of uniform thickness.

* * * * *